US006435860B1

(12) United States Patent
Brookshire et al.

(10) Patent No.: US 6,435,860 B1
(45) Date of Patent: Aug. 20, 2002

(54) LANDFILL CONDENSATE INJECTION SYSTEM

(75) Inventors: Ronald L. Brookshire; Travis Brookshire, both of Alpine; Robert Hamilton, Riverside, all of CA (US)

(73) Assignee: LFG & E International, El Cajon, CA (US)

( * ) Notice: Subject to any disclaimer, the term of this patent is extended or adjusted under 35 U.S.C. 154(b) by 0 days.

(21) Appl. No.: 09/561,053

(22) Filed: Apr. 28, 2000

(51) Int. Cl.[7] ..... F23D 14/00; F23G 7/08

(52) U.S. Cl. ..... 431/202; 431/5; 431/75; 431/9; 431/185; 431/161; 110/346; 110/238; 110/258; 239/463

(58) Field of Search ..... 431/202, 5, 4, 431/75, 11, 210, 9, 185, 187, 161; 239/403, 399, 461, 463, 487, 492, 601; 110/346, 238, 235, 258, 203

(56) References Cited

U.S. PATENT DOCUMENTS 3,666,183 A * 5/1972 Smith ..... 239/463
3,799,449 A * 3/1974 Gardner ..... 239/403
4,127,379 A * 11/1978 Grove ..... 431/4
4,475,466 A * 10/1984 Gravely ..... 110/238
4,850,857 A * 7/1989 Obermuller ..... 431/5
5,067,657 A * 11/1991 Young et al. ..... 239/403
5,484,279 A * 1/1996 Vonsaek ..... 431/202
5,601,040 A * 2/1997 McGill ..... 110/346
5,609,104 A * 3/1997 Yap ..... 110/235
5,622,489 A * 4/1997 Monro ..... 431/187
6,024,301 A * 2/2000 Hurley et al. ..... 239/463
6,237,512 B1 * 5/2001 Inoue ..... 431/5

FOREIGN PATENT DOCUMENTS

WO WO-84/01421 A1 * 4/1984 ..... 431/202

* cited by examiner

*Primary Examiner*—Henry Bennett
*Assistant Examiner*—Josiah C. Cocks
(74) *Attorney, Agent, or Firm*—John L. Rogitz

(57) ABSTRACT

An automated, computer-controlled landfill condensate injection system includes a pump that pumps condensate into a flare chamber at a pressure that is sufficiently high and through a nozzle that is configured to vaporize the condensate without requiring the use of high pressure air injected with the condensate. Secondary injection lines can also be provided that terminate in nozzles which are vertically staggered from each other along the chamber, to inject additional condensate into the flare and thus dispose of it at a higher rate depending on vaporization conditions. Computer-controlled valves can be provided in the lines for selectively opening and closing the lines.

15 Claims, 3 Drawing Sheets

138

LANDFILL CONDENSATE INJECTION SYSTEM

FIELD OF THE INVENTION

The present invention relates generally to landfills, and more particularly to systems and methods for disposing of liquid condensate from landfill gas recovery systems.

BACKGROUND

Waste products decompose in landfills, and after the free oxygen in the landfill is depleted, the waste product decomposition generates methane gas. It is desirable to recover this methane gas for environmental and safety reasons. To this end, landfill gas recovery systems have been introduced which collect the gas generated in landfills and burn the gas in flares on the landfill.

Occasionally, gas in the recovery system condenses with other fluids such as water. This methane-based condensate, like the gas, must be removed from the landfill for safety and environmental reasons, and to ensure that blockage of gas piping and damage to the flare system does not occur. Typically, the condensate is simply pumped out of the gas recovery system and transported to a hazardous waste dump site, where it is disposed of.

As recognized herein, transporting hazardous condensate to another waste facility for disposal is not only expensive, it does not solve the environmental problem of disposing of the condensate, but rather only moves the problem to a hazardous waste disposal facility. With this in mind, the present invention recognizes the desirability of economically disposing of the condensate at the site at which it is recovered in an environmentally benign way.

As recognized herein, one method for disposing of the condensate is to burn it in the flare chamber that is used to burn the methane gas. Typically, a landfill gas recovery flare chamber includes a ring of vertically-oriented burners located near the bottom of the chamber, and methane gas is piped through the burners and oxidized, with the hot oxidation products exhausting upwardly up through the flare chamber and out of the open top end of the chamber. In such a flare chamber, the condensate can be injected radially into the flare chamber above the burners by entraining the condensate in a pressurized high velocity air stream above the flame of the flare.

Such a system, as understood by the present invention, unfortunately requires a relatively expensive air compressor to generate the pressurized air stream. Also, a portion of the high velocity condensate stream tends to impinge on the wall of the flare chamber that is opposite the condensate injection point, damaging the wall.

Alternatively, the present invention understands that condensate can be pumped upwardly into the flare chamber through a vertical pipe that is centrally located in the flare chamber below the ring of burners. As the condensate moves upwardly past the burners, it flashes into vapor. As recognized by the present invention, however, the injection rate of condensate sometimes must undesirably be limited to avoid excessively cooling the flare chamber as the latent heat of vaporization of the condensate is overcome. Excessively cooling the flare chamber could reduce the ability of the flare to burn the methane gas and condensate. Moreover, the present invention understands that landfill process controls, including those related to condensate injection systems, preferably be automatic, to more accurately control the processes and to avoid the necessity of personnel undertaking time consuming and repetitive process monitoring and adjustment.

As further recognized herein, it is possible to provide a condensate injection system having a relatively high condensate injection rate without excessively cooling a flare chamber, and to automatically control the condensate injection rate as appropriate for the particular energy level of the flare. Accordingly, it is an object of the present invention to address one or more of the abovenoted considerations.

SUMMARY OF THE INVENTION

A compressorless condensate injection system is disclosed for a landfill having a flare chamber including at least one wall that is heated when the flare chamber burns methane gas extracted from the well. The system includes a condensate reservoir and a condensate pump in fluid communication with the reservoir to pump condensate into the chamber at a high pressure, preferably 40–250 pounds or more. At least a first injection line is in fluid communication with the condensate pump but not with an air compressor. The first line terminates in a first nozzle that is positioned on the flare chamber for directing condensate into the chamber such that condensate from the nozzle is vaporized when it is sprayed into the chamber without requiring the use of compressed air.

In a preferred embodiment, the first line has a heat exchange segment that is curved, e.g., the segment can extend partially or completely around the flare chamber before terminating in a nozzle. In this way, fluid in the first line can be heated when the flare chamber burns gas extracted from the well.

A first control valve preferably is in fluid communication with the first injection line for selectively blocking fluid flow therethrough, with the first control valve being responsive to electrical control signals. Indeed, secondary injection lines with respective solenoid valves and nozzles can be provided for selectively injecting even greater amounts of condensate into the chamber, depending on vaporization conditions. These secondary nozzles can be oriented to direct condensate upwardly and radially inwardly into the flare chamber. If desired, a ring line can communicate with the condensate pump, and the ring line terminates in a ring line nozzle disposable adjacent the burners of the flare.

Additional features can include a methane gas inlet line and a methane sensor for measuring a methane concentration in the inlet line, a flow sensor for measuring gas flow rate in the inlet line, and a temperature sensor for sensing temperature in the flare chamber. Also, condensate temperature and pressure can be measured in each heat exchange segment. Electrical control signals for controlling the solenoid valves can be generated by a computer based on these signals.

In another aspect, a computer program device can include a computer program storage device readable by a digital processing system, and a computer program on the program storage device and including instructions executable by the digital processing system for performing method steps for controlling at least one control valve disposed in at least one condensate injection line in a landfill flare chamber. The method undertaken by the computer includes determining a gas volume burn rate based on a combination of methane concentration in gas to be burned in the chamber, flow rate of gas, and flare chamber temperature. Also, the computer generates one or more control signals to control the valve or valves in response to the determination of gas volume burn rate.

In still another aspect, a condensate injection nozzle includes a nozzle body defining a pathway therethrough, and an orifice element disposed in the pathway. An diversion plate is also disposed in the pathway. In accordance with present principles, the diversion plate causes turbulent flow of the condensate, prior to the condensate passing through the orifice element and being injected into the flare chamber.

The details of the present invention, both as to its structure and its operation, can best be appreciated in reference to the accompanying drawings, in which like reference numerals refer to like parts, and in which:

DETAILED DESCRIPTION OF THE PREFERRED EMBODIMENT

Figure 1:
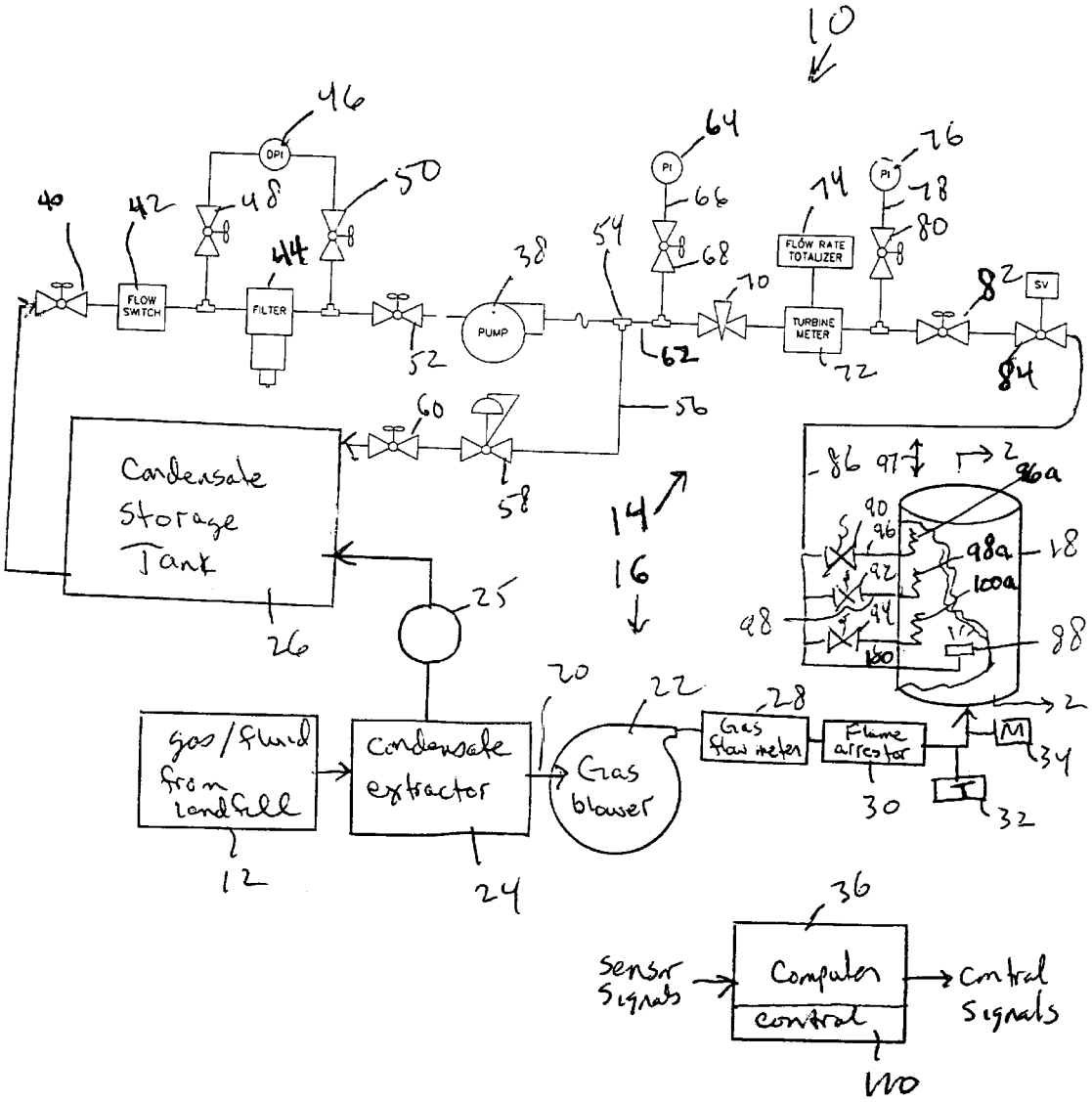
FIG. 1 is a schematic diagram of the present condensate injection system shown in one intended environment with a flare chamber and accompanying gas injection components, with portions of the flare chamber insulation layer broken away.

Referring initially to FIG. 1, a system is shown and generally designated 10 for burning methane gas from a landfill 12. As shown, the system 10 includes a condensate injection system, generally designated 14, and a gas injection system, generally designated 16. As disclosed in detail below, the injection systems 14, 16 respectively inject liquid condensate from the landfill 12 and gas from the landfill 12 into a cylindrical metal flare chamber 18, for disposal of the condensate and gas by vaporization.

In one embodiment, the flare chamber of the present invention can be a conventional candle flare chamber or enclosed flare chamber that is conventionally affixed to the landfill 12. Or, the flare chamber 18 with condensate injection system 14 can be mounted on a flat movable trailer. In such an embodiment, the flare chamber 18 can be tiltably mounted on the trailer.

With regard to the gas injection system 16, gas from the landfill 12 enters a main gas inlet pipe 20 under vacuum supplied by a blower 22. The gas first passes through a condensate extractor or filter 24 that removes condensate from the gas, the effluent of which is pumped by a pump 25 to a condensate storage tank 26 in the condensate injection system 14. If desired, the storage tank 26 can be omitted.

In the preferred embodiment, the gas passes through a flow metering device 28, preferably one of the devices disclosed in U.S. Pat. No. 5,616,841, owned by the assignee of the present invention and incorporated herein by reference. Then, the gas passes through a flame arrestor 30 that establishes a fire boundary to prevent flames from the flare chamber 18 from propagating past the arrestor 30, and the gas then flows into the chamber 18.

As shown in FIG. 1, a temperature sensor 32 and a methane concentration sensor 34 are disposed in the flare inlet pipe or other suitable location (i.e., directly on the flare chamber 18) to sense the temperature inside the flare chamber 18 and the methane concentration of the gas entering the chamber 18. It is to be understood that the sensors 28, 32, 34 are in data communication with a computer 36 via RF, IR, or electric wire for sending their respective output signals to the computer 36 as described below.

Having described the gas injection system 16 and turning now to the condensate injection system 14, a condensate pump 38 is provided for pumping condensate through the injection system 14. In one preferred embodiment, the pump 38 is a rotary vane pump that discharges condensate such that the condensate is injected into the chamber 18 at 40–250 pounds pressure or more. Alternatively the pump 38 can be a diaphragm pump or other suitable device. This high pressure, in addition to the nozzle structure shown below, ensures that the condensate will be vaporized without requiring the use of a high pressure air compressor. Accordingly, the injection system 14 is a compressorless system.

The flow path of condensate through the preferred condensate injection system 14 is as follows. From the storage tank 26, condensate flows past a manually operated tank outlet isolation valve 40 to a flow switch 42. It is to be understood that the flow switch outputs a signal representative of whether condensate is in the system 14. This switch can be sent to the computer 36 and used by the computer 36 to deenergize the motor of the pump 38 when no condensate is available, to protect the pump 38.

From the flow switch 42 the condensate flows to a particulate filter 44, which extracts large particles from the condensate. If desired, a differential pressure sensor 46 can sense the differential pressure across the filter 44 to indicate whether the filter 44 requires cleaning or maintenance. Sensor isolation valves 48, 50 are provided in the sensor 46 line to isolate the sensor 46.

Next, the condensate flows through a manually operated pump inlet isolation valve 52 to the pump 38. From the discharge of the pump 38, condensate flows to a T connector or other three-way connector 54. Condensate can flow from the connector 54 through a recirculation line 56 to a back pressure regulator valve 58, which senses pressure at the discharge of the pump 38 and opens and closes as appropriate to ensure that a predetermined high discharge pressure is not exceeded. As shown in FIG. 1, condensate flowing through the regulator valve 58 flows through a tank inlet isolation valve 60 back to the condensate storage tank 26.

A main injection line 62 branches from the T connector 54, and a first pressure indicator 64 communicates with the line 62 by means of a first tap line 66 with isolation valve 68, to sense pressure in the line 62. Condensate flows past the first tap line 66 to a flow adjusting valve 70. In one embodiment, the flow adjusting valve 70 can be a needle-type valve which is manually set to establish a predetermined flow rate through the line 62. Or, the flow adjusting valve 70 can be a solenoid valve that is controlled by the computer 36 to dynamically establish a flow rate through the line 62.

Still referring to FIG. 1, a flow rate meter 72 is downstream of the flow adjusting valve 70 for measuring the flow rate of condensate through the main line 62. The flow rate meter 72 can communicate with a flow rate totalizator 74, which in turn can present a visual display of instantaneous flow rate and total flow and/or communicate with the computer 36 to send a flow rate signal thereto. In one embodiment, the flow rate meter 72 is a turbine-type meter.

A second pressure indicator 76 communicates with the main injection line 62 by means of a second tap line 78 with isolation valve 80, to sense pressure in the line 62 and to provide a visual indication thereof and/or electrical indication to the computer 36. Condensate flows past the second tap line 78 to a manually operated injection isolation valve 82, and thence to a solenoid-controlled main injection valve 84.

From the main injection valve 84, the condensate flows through a primary injection line 86 into the chamber 18, into which it is injected at high pressure through a vertically-oriented main nozzle 88. Moreover, FIG. 1 shows that the main condensate injection line 86 directs condensate to a valve manifold that includes at least first through third secondary control valves 90, 92, 94. In the preferred embodiment, the control valves 86 and 90–94 are solenoid valves that are in data communication with the computer 36 for opening or shutting the control valves on an individual basis.

The secondary control valves 90–94 lead to respective first through third secondary injection lines 96, 98, 100. As can be appreciated in reference to FIG. 1, the secondary injection lines 96–100 direct condensate into the flare chamber 18 in accordance with disclosure below.

Figure 2:
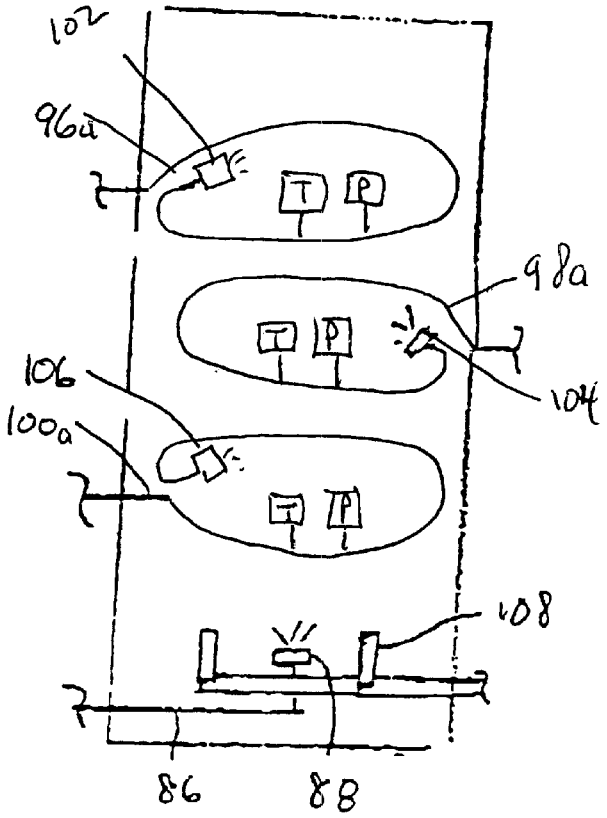
FIG. 2 is a schematic view from an elevational perspective of the present flare chamber, showing the condensate nozzles, with the heat exchange segments of the secondary injection lines schematically shown as winding once around the inside of the flare chamber, it being understood that further coils can be provided for each segment if desired.

Further inventive features of the condensate injection system 14 can be appreciated in cross-reference to FIGS. 1 and 2. As shown, the three secondary injection lines 96, 98, 100 are all higher than the main nozzle 88 and are vertically staggered relative to each other. The secondary lines include respective first through third curved heat exchange segments 96*a*, 98*a*, 100*a*. The segments 96*a*, 98*a*, 100*a* can be serpentine-shaped as shown, or as schematically shown in FIG. 2 they can extend around the inside periphery or the inner refractory of the chamber parallel to the ground or slanted with respect to the ground, prior to terminating in respective nozzles. In any case, the length of the segments ensures that heat from the flare will be transferred through the segments into the condensate that is carried in the segments. In one preferred embodiment, each heat exchange segment 96*a*, 98*a*, 100*a* includes a respective condensate injection temperature monitor "T" and a respective condensate injection pressure monitor "P" which can be in data communication with the present computer.

If desired, the heat exchange segments 96*a*, 98*a*, 100*a* can be sandwiched between the wall of the flare chamber 18 and an insulation layer, for shielding the wall of the flare chamber 18 from people. With this structure, fluid in the heat exchange segments 96*a*, 98*a*, 100*a* of the condensate injection lines 96–100 can be heated by the wall of the flare chamber 18 when the flare chamber 18 burns gas that is extracted from the landfill, to thereby preheat the condensate prior to injection into the flare. As recognized by the present invention, such preheating reduces the amount of heat necessary to burn the condensate, thereby increasing the capacity of the flare to burn condensate. Moreover, should it be desired to dispose of landfill leachate in lieu of or in addition to condensate, the leachate is filtered to remove heavy metals and particles, with the above-described preheating effectively facilitating leachate disposition in the flare.

Desirably, to promote heat transfer the heat exchange segments 96*a*–100*a* are radially staggered from each other relative to the flare chamber 18. It is to be understood that the heat exchange segments 96*a*, 98*a*, 100*a* can be disposed on the interior surface of the chamber 18, and that the segments 96*a*–100*a*, instead of being serpentine-shaped, can be wound around the wall 18*a* in respective helical patterns or other patterns that optimize preheating condensate before it is injected into the flare.

In cross-reference to FIGS. 1 and 2, each secondary injection line 96–100 passes through the wall of the flare chamber 18 and terminates in a respective secondary nozzle 102, 104, 106, with the secondary nozzles being positioned near the interior surface of the flare chamber 18. The secondary nozzles can be identical in configuration to the main nozzle 88, described in greater detail below.

As best shown in FIG. 2, the higher three (i.e., secondary) nozzles 102, 104, 106 are oriented to direct condensate upwardly and radially inwardly into the flare chamber 18. Moreover, the nozzles are vertically staggered with respect to each other. Thus, the highest nozzle 102 is higher than the next highest nozzle 104 and so on.

In contrast, the lowest, i.e., main, nozzle 88 is positioned below and radially central to a ring of burners 108, in the flare chamber 18 near the bottom thereof. Accordingly, the main condensate injection line 86 establishes a ring line that is in communication with the condensate pump 38. If desired, the main injection line 86 may include a heat exchange segment.

With the above disclosure in mind, the present invention envisions regulating condensate flow into the flare chamber 18 based on a gas oxidation rate in the flare chamber 18. More specifically, As best shown in FIG. 2, the higher three (i.e., secondary) nozzles 102, 104, 106 are oriented to direct condensate upwardly and radially inwardly into the flare chamber 18. Moreover, the nozzles are vertically staggered with respect to each other. Thus, the highest nozzle 102 is higher than the next highest nozzle 104 and so on.

In contrast, the lowest, i.e., main, nozzle 88 is positioned below and radially central to a ring of burners 108, in the flare chamber 18 near the bottom thereof. Accordingly, the main condensate injection line 86 establishes a ring line that is in communication with the condensate pump 38. If desired, the main injection line 86 may include a heat exchange segment.

With the above disclosure in mind, the present invention envisions regulating condensate flow into the flare chamber 18 based on a gas oxidation rate in the flare chamber 18. More specifically, the higher the gas oxidation rate, the more condensate may be injected into the flare chamber 18, and vice versa. Accordingly, the condensate control valves 84 and 90–94 receive electrical control signals from the computer 36 to either individually open or individually shut the valves, based on the oxidation rate, although in other embodiments the control valves might be throttled based on the control signals. As disclosed in detail below, the computer 36 determines the oxidation rate and generates the control signals based on one or more of the signals from the temperature sensor 32, the methane concentration sensor 34, and the gas flow meter 28.

Now turning to the condensate injection control regime of the present invention, the computer 36 can be a personal computer (PC), a laptop computer, or other microprocessing device having an associated man-machine interface such as a video monitor and an associated input device such as a keyboard, mouse, touch screen, ball, or other appropriate input device. Additionally, the computer 36 can include an associated modem for communicating with a computer network (not shown).

As described in detail below, the computer 36 has a control module 110 that controls the control valves based on gas flow properties of the flare. The control module 110 of the present invention can be embodied in computer program software. Manifestly, the invention is practiced in one essential embodiment by a machine component that renders the computer program code elements in a form that instructs a digital processing apparatus (that is, a computer) to perform a sequence of operational steps corresponding to those disclosed herein.

These instructions may reside on a program storage device including a data storage medium, such as a computer diskette. The machine component can be a combination of program code elements in computer readable form that are embodied in a computer-usable data medium on the computer diskette. Alternatively, such media can also be found in semiconductor devices, on magnetic tape, on optical disks, on a DASD array, on magnetic tape, on a conventional hard disk drive, on electronic read-only memory or on electronic ransom access memory, or other appropriate data storage device. In an illustrative embodiment of the invention, the computer-executable instructions may be lines of compiled $C^{++}$ language code.

It is to be understood that the present invention alternatively can be implemented by logic circuits. As yet another alternative, the present invention can be implemented by a circuit board, and the operative components of the control module 110 accordingly would be electronic components on the circuit board.

Figure 3:
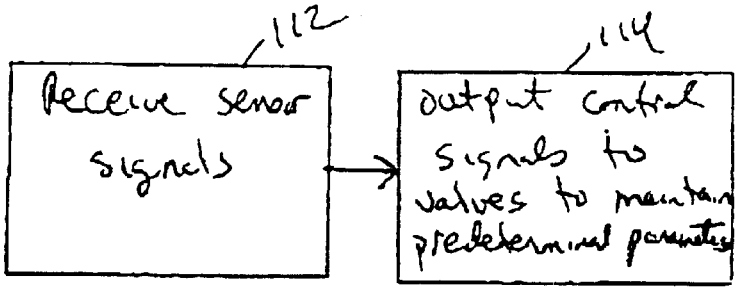
FIG. 3 is a flow chart of the present logic.

Referring now to FIG. 3, the overall logic of the module 110 of the computer 36 receives signals at block 112 from the sensors described above. These signals, as mentioned, can include gas inlet methane concentration, gas inlet temperature, gas flow rate, condensate injection temperature and/or pressure, and condensate flow rate. Using these signals, the computer can, as but one example, determine a gas volume burn rate. Then, at block 114 the computer 36 outputs control signals to maintain one or more parameters at predetermined levels. The computer 36 can output control signals to the secondary injection valves 96–100 in response to the gas volume burn rate. Alternatively or in addition, the computer 36 can cause the control valves to sequentially open, from, e.g., lowest to highest, based on gas inlet temperature, with higher temperatures indicating that more condensate can be disposed of and thus causing the computer 36 to open the control valves more rather than less. Or, the computer 36 might seek to establish a predetermined condensate flow rate based on one or more of gas temperature, condensate temperature, gas and/or condensate flow rate, etc.

Figure 4:
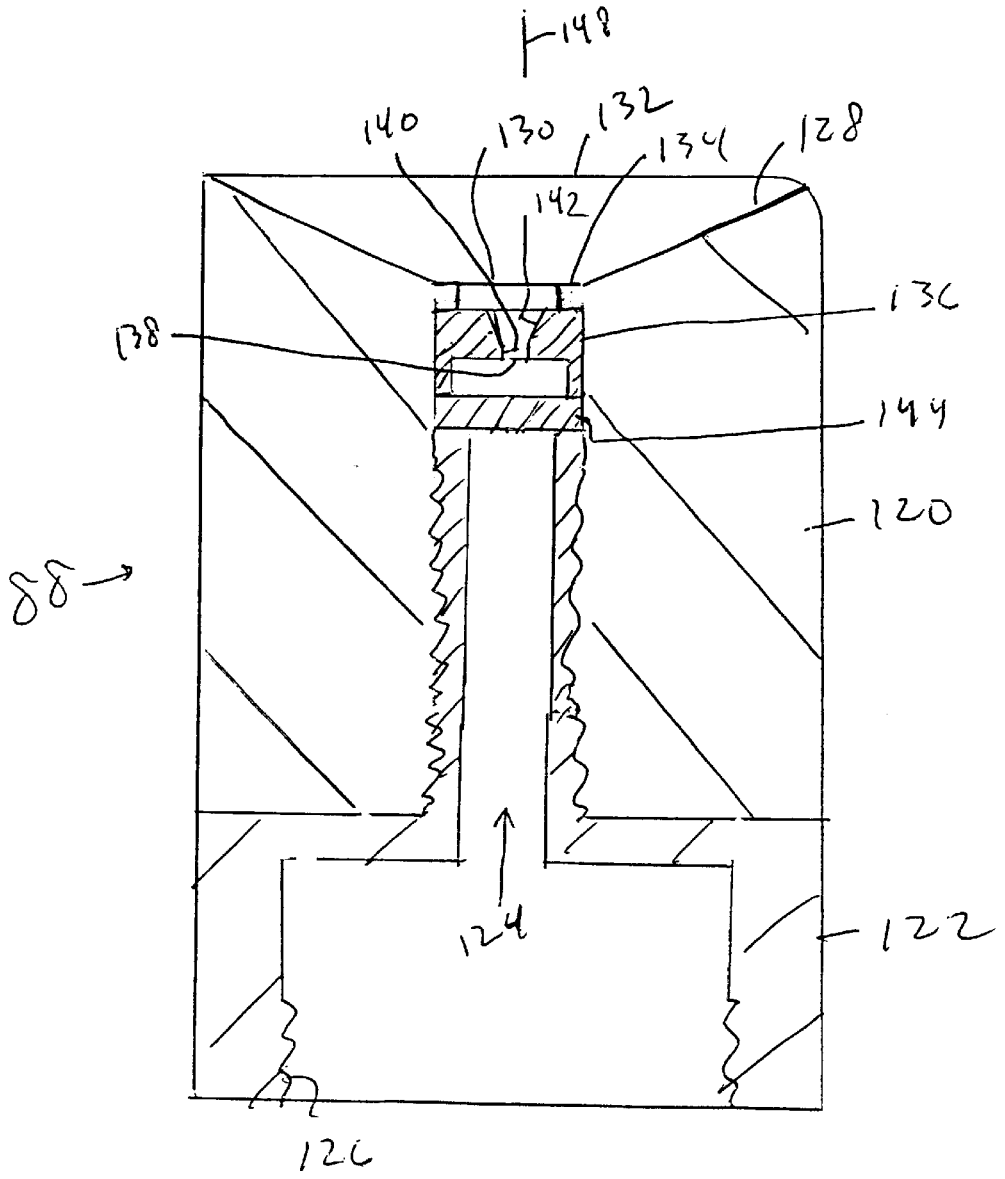
FIG. 4 is a cross-sectional diagram of the preferred nozzle.

Now referring to FIG. 4, the details of the preferred nozzles of the present invention can be seen. As shown, a hollow metal nozzle body 120 can be threaded to a hollow nozzle base 122, with a central fluid pathway 124 being defined therethrough. In turn, the nozzle base 122 can have internal threads 126 for engaging the end of an injection line. If desired, a compression washer can be sandwiched between the body 120 and base 122.

The nozzle body 120 is formed with an outwardly expanding spray end 128 as shown. Specifically, the spray end 128 expands radially outwardly from a smaller medial opening 130 to a larger distal opening 132. A retaining lip 134 circumscribes the medial opening 130.

As shown in FIG. 4, an orifice element 136 is juxtaposed with the medial opening 130 in the pathway 124, and the orifice element 136 is retained in the body 120 by the retaining lip 134. The orifice element 136 defines a central orifice 138 that communicates with the central pathway 124. In the preferred embodiment, the orifice 138 defines a cylindrical, relatively narrow proximal portion 140 that terminates in an outwardly tapering frusto-conical portion 142.

Proximal to the orifice element 136 and disposed within the central pathway 124 is a metal disc-shaped diversion plate 144. As described more fully below, the plate 144 is formed with several obliquely-oriented slots to create swirling turbulence as the condensate passes therethrough, such that the condensate is atomized when it passes through the orifice element 136.

Figure 5:
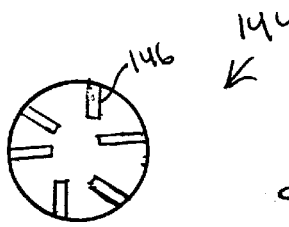
FIG. 5 is a top plan view of the diversion plate.
Figure 6:
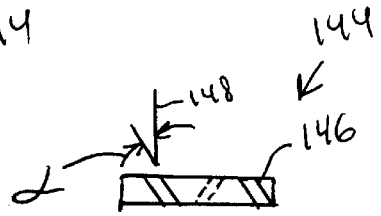
FIG. 6 is a side elevational view of the diversion plate, showing one of the slots in phantom.

More specifically, in cross-reference to FIGS. 5 and 6, the plate 144 is formed with slots 146 that are oriented at an oblique angle a relative to the longitudinal axis 148 of the pathway 124 when viewed from the edge of the plate 144. In one preferred embodiment, six slots 146 are shown, and the angle $\alpha$ is between 30°–60°, and more preferably is 45°.

While the particular LANDFILL CONDENSATE INJECTION SYSTEM as herein shown and described in detail is fully capable of attaining the above-described objects of the invention, it is to be understood that it is the presently preferred embodiment of the present invention and is thus representative of the subject matter which is broadly contemplated by the present invention, that the scope of the present invention fully encompasses other embodiments which may become obvious to those skilled in the art, and that the scope of the present invention is accordingly to be limited by nothing other than the appended claims. Moreover, it is not necessary for a device or method to address each and every problem sought to be solved by the present invention, for it to be encompassed by the present claims. Furthermore, no element, component, or method step in the present disclosure is intended to be dedicated to the public regardless of whether the element, component, or method step is explicitly recited in the claims. No claim element herein is to be construed under the provisions of 35 U.S.C. §112, sixth paragraph, unless the element is expressly recited using the phrase "means for" or, in the case of a method claim, the element is recited as a "step" instead of an "act".

What is claimed is:

1. A condensate injection system for a landfill having a flare chamber, the flare chamber being heated when the flare chamber burns methane gas extracted from the well, comprising:

a condensate reservoir;

a condensate pump in fluid communication with the reservoir; and at least a first injection line, the first line being in fluid communication with the condensate pump, the first line terminating in a first nozzle positionable on the flare chamber for directing condensate into the chamber such that condensate from the nozzle is vaporized when it is sprayed into the chamber; and at least a second injection line terminating in a second nozzle positionable on the flare chamber above the first nozzle and oriented to direct condensate upwardly and inwardly into the flare chamber.

2. The system of claim 1, wherein the first line has a heat exchange segment, the heat exchange segment being heated within the flare chamber when the flare chamber burns gas extracted from the well, the segment being at least partially curved in the flare chamber.

3. The system of claim 1, further comprising a first control valve in fluid communication with the first injection line for selectively blocking fluid flow therethrough, the first control valve being responsive to electrical control signals.

4. The system of claim 2, wherein the flare chamber includes plural burners, and the system further comprises:

a ring line in communication with the condensate pump, the ring line terminating in a ring line nozzle disposable adjacent the burners.

5. The system of claim 1, further comprising:

at least a second injection line, the second line being in fluid communication with the condensate pump, the second line terminating in a second nozzle positionable on the flare chamber above the first nozzle for directing condensate into the chamber.

6. The system of claim 1, wherein the second line has an at least partially curved heat exchange segment within the flare chamber such that fluid in the second line can be heated by the wall when the flare chamber burns gas extracted from the well.

7. The system of claim 1, wherein the pump pumps condensate into the chamber at a pressure of at least forty pounds per square inch.

8. The system of claim 1, wherein the nozzle includes an orifice element and a diversion plate juxtaposed with the orifice element for atomizing condensate prior to the condensate passing through the orifice element.

9. The system of claim 3, wherein the flare chamber includes a methane gas inlet line, and the system further comprises a methane sensor for measuring a methane concentration in the inlet line, a flow sensor for measuring gas flow rate in the inlet line, and a temperature sensor for sensing temperature in the flare chamber, and wherein electrical control signals are generated based on signals from at least one sensor.

10. The system of claim 9, in further combination with a computer for generating the control signals, the computer being in data communication with the valve.

11. A condensate injection nozzle, comprising:

a nozzle body defining a pathway therethrough;

an orifice element disposed in the pathway;

a disk-shaped diversion plate disposed in the pathway, the diversion plate being formed with plural slots through which condensate can flow to cause turbulence in the condensate;

a flare chamber disposed around the nozzle; and a condensate injection system communicating with the nozzle, the condensate injection system including a condensate reservoir, a condensate pump in fluid communication with the reservoir and at least a first injection line communicating with the condensate pump and nozzle, wherein the first line has a heat exchange segment extending at least partially around a wail of the flare chamber such that fluid in the first line can be heated when the flare chamber burns gas.

12. The nozzle of claim 11, further comprising a first control valve in fluid communication with the first injection line for selectively blocking fluid flow therethrough, the first control valve being responsive to electrical control signals.

13. The nozzle of claim 11, wherein the pump pumps condensate into the chamber at a pressure of at least forty pounds per square inch.

14. The nozzle of claim 11, wherein the nozzle body defines a long axis, and the slots establish oblique angles with the axis.

15. A condensate injection system for a landfill having a flare chamber, the flare chamber being heated when the flare chamber burns methane gas extracted from the well, comprising:

a condensate reservoir;

a condensate pump in fluid communication with the reservoir;

at least a first injection line, the first line being in fluid communication with the condensate pump and not communicating with an air compressor, the first line terminating in a first nozzle positionable on the flare chamber for directing condensate into the chamber such that condensate from the nozzle is vaporized when it is sprayed into the chamber without requiring the use of compressed air;

a methane gas inlet line disposed to direct methane into the chamber;

a methane sensor measuring a methane concentration in the methane gas inlet line;

a flow sensor measuring gas flow rate in the methane gas inlet line;

a temperature sensor sensing temperature in the flare chamber; and a first control valve in fluid communication with the first injection line for selectively blocking fluid flow therethrough, the first control valve being responsive to electrical control signals derived from at least one of the sensors.

* * * * *